United States Patent [19]

Soltau

[11] Patent Number: 4,630,967

[45] Date of Patent: Dec. 23, 1986

[54] ARRANGEMENT FOR UNDERGROUND ADVANCE DRIVING OF PIPE TRAINS COMPOSED OF INDIVIDUAL PIPE LENGTHS

[76] Inventor: Gerd Soltau, Artlenburger Landstr. 15, D-2120 Luneburg, Fed. Rep. of Germany

[21] Appl. No.: 714,768

[22] Filed: Mar. 22, 1985

[30] Foreign Application Priority Data

Oct. 27, 1984 [DE] Fed. Rep. of Germany ..... 3439433
Oct. 30, 1984 [DE] Fed. Rep. of Germany ..... 3439620

[51] Int. Cl.[4] ..... F16L 1/02

[52] U.S. Cl. ..... 405/184; 405/143; 405/154

[58] Field of Search ..... 405/133, 138, 141, 143, 405/154, 184; 175/61, 62, 219

[56] References Cited

U.S. PATENT DOCUMENTS

| | | | |
|---|---|---|---|
| 4,024,721 | 5/1977 | Takada et al. | 405/184 |
| 4,176,985 | 12/1979 | Cherrington | 405/184 |
| 4,318,835 | 3/1982 | Clarke | 405/184 X |
| 4,388,021 | 6/1983 | Weiss | 405/184 |
| 4,423,981 | 1/1984 | Nilberg | 405/133 |

FOREIGN PATENT DOCUMENTS

| | | |
|---|---|---|
| 1534677 | 1/1970 | Fed. Rep. of Germany . |
| 2701066 | 9/1977 | Fed. Rep. of Germany . |
| 8205543 | 8/1982 | Fed. Rep. of Germany . |

OTHER PUBLICATIONS

"TIS", Aug. 1981, pp. 550–554.
"TIS", Mar. 1982, pp. 129–134.

*Primary Examiner*—David H. Corbin
*Attorney, Agent, or Firm*—Edwin E. Greigg

[57] ABSTRACT

The invention refers to an arrangement for underground driving of pipe trains composed of individual pipe lengths of non-man-sized diameters. The arrangement works with a pressing unit driving the pipe trains from driving pits. The soil in face of the arrangement is excavated by means of a scraper. Conveyors transport the excavated waste soil back into the driving pit. The walls of massive material of the pits, which will serve as inspection pits later-on in the pipe trains, when driving are the walls of the driving pits, while the driving unit is propped-up on the wall of the respective driving pit used as a driving pit. The wall of the driving pit has a preferably circular shape and is composed of concrete rings. Above the driving pit a container is arranged with an opening in the bottom through which the driving unit can be hoisted down into the driving pit. In the container all working tools and appliances for operating the driving unit are permanently housed ready for use.

11 Claims, 8 Drawing Figures

FIG. 7
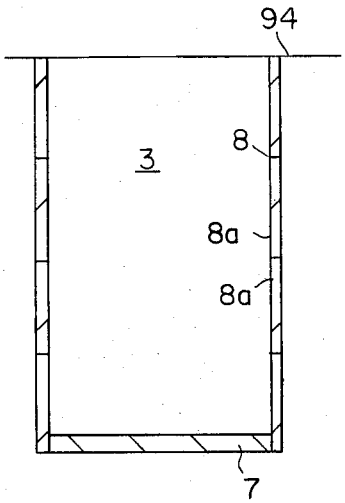
FIG. 8
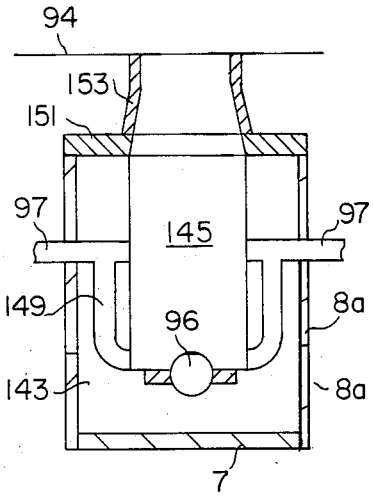
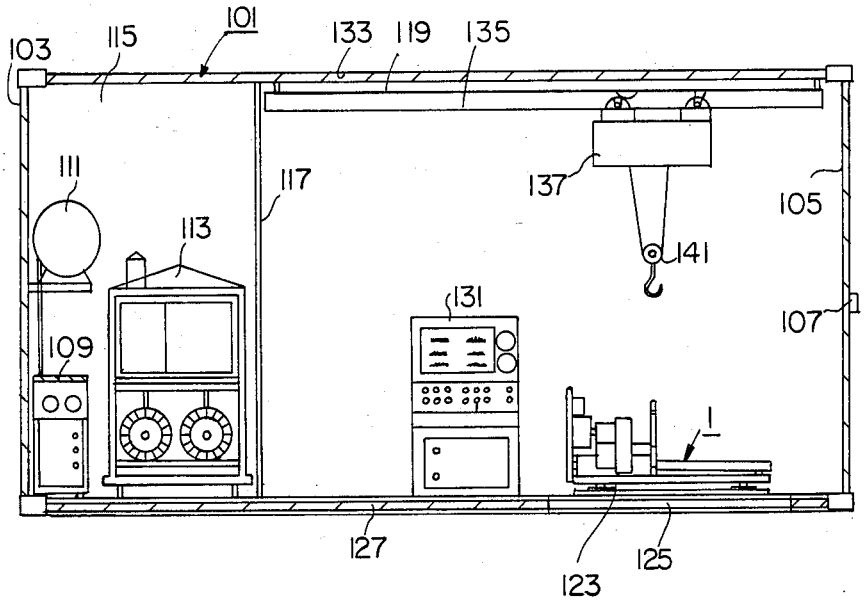
FIG. 5

ARRANGEMENT FOR UNDERGROUND ADVANCE DRIVING OF PIPE TRAINS COMPOSED OF INDIVIDUAL PIPE LENGTHS

The invention refers to an arrangement for underground driving of pipe trains composed of individual pipe lengths having non-man-sized nominal diameters, using a driving unit which presses the pipe trains from driving pits with scrapers excavating the soil in place and conveyors transporting the excavated soil into the driving pit.

The driving of product pipes of non-man-sized nominal diameters inside the ground is known from the DE-GmS (German Legal Protection for Registered Utility Models) No. 82 05 543.

By means of a driving unit not represented here from a driving pit pipe lengths placed one behind the other are pressed into the ground. In front of the first pipe length a hydraulically controlled steering head is mounted to a follower pipe. The first product pipe presses against this follower pipe. Inside the pipe train composed of product pipes a guide pipe is provided for guiding the conveyor worm. The conveyor worm has a scraper disk at its front end excavating the soil in place. The conveyor worm transports the soil back into the driving pit. A target aiming contrivance controls the steering head in front of the follower pipe by means of hydraulic valves and direction control cyclinders so that the drive direction can be corrected. The determination of the error compensation value is effected by means of a laser unit projecting a laser beam onto a target unit. Deviations from the desired reference hit point are evaluated for correcting the course of the pipe train by adjusting the direction control cylinders at the steering head.

The driving pits in which the driving units are installed are normally lined with wooden planks held in position at the pit walls by steel rods driven vertically into the ground. Such driving pits are rectangular and have a relatively big size of e.g. 9×3 m (30×10 ft.). Those driving pits have a negative effect on the construction costs and take considerable floor space thereby disqualifying the pipe drive method especially for in-town application.

The objective of the invention is to provide an arrangement for the underground driving of pipe trains composed of individual product pipe lengths of non-man-sized nominal diameters which is particularly suitable for in-town application by substantially reducing the building work with respect to its overground and underground space requirements as well as to expenditures incurred.

The objective has been met according to the invention by the fact that the walls of a massively rated material thickness of the pits, which will serve later-on in the pipe trains as inspection chambers, when driving are the walls of the driving pits in which the driving unit is propped-up on the wall of the respective pit used as a driving pit.

The driving unit when driving the pipes is propped-up on the wall opposite the drive side of the pit by means of a back-up wall shaped to match the form of the pit, the driving pit and the back-up wall having preferably a cylindrical shape. By means of the back-up wall the frame of the driving unit is propped-up with its full surface on the wall of the driving pit over a particularly large bearing area. Thus a good propping pressure distribution results.

The size or the diameter of the cyclindrical inspection chambers is conditioned by the local building regulations and is approx. max. 2 m (6'-6"). If the massive driving pits preferably build-up of cylindrical concrete rings piled up one upon the other have the same section as the inspection chambers, the driving pit wall lining, which in conventional methods has to be removed after completing the job, can be used as wall lining for the inspection chambers, so that for installing pipe trains only pits have to be built which can remain in place later-on and after certain transformations serve as chambers. Thereby the expenditure incurred when building such pipe trains is reduced considerably. Sinking of an inspection chamber in a large excavation, removing the lining boards and propping and staying of this excavation after completing the job and filling of the remaining excavation can be dispensed with.

In order to make superfluous the costly and in urban areas obstructive building of house sewers in the open-cut method, another elaboration of the invention is marked by the fact that the pipe trains have a radial layout starting from the cylindrical driving pit, which will be transformed later-on into an inspection chamber, and that the side-cut house sewers driven to the individual house lots or houses are lead together into the driving pit when transforming it with pipe-shaped or trough-shaped inlet conduits. Thus, the house sewers are driven underground radially from the driving pit serving later-on as an inspection chamber. The driving unit after completing a drive job is turned into a new direction and work can continue. In this way also an underground installation of house sewers is very economical.

Having a diameter of approx. 2 m (6'-6") the driving pit can be built-up of concrete ring series produced by ancillary industries. Such pits can be sunk-in without noisy pile-driving. When building sewers there will be no noise or damages caused by the pile-driving. Due to the reduced driving pit diameters short product pipe lengths of approx. 1 m (3'-3") are used. This has the added advantage that the product pipes are easy to handle and that curve driving can be made.

For driving pipes of non-man-sized diameters of e.g. 250 thru 400 mm (10 thru 16 ins.) a pipe driving unit and additional appliances such as compressed air unit, electrical generating set, measuring instruments and control units are used. When a drain is to be driven underground, for installing the site sinking of a driving shaft or pit, the availability of a driving unit and its hoisting-down into the driving pit as well as installing a working place accommodating the energy generating units, the measuring and control appliances are necessary. Normally the pipe driving unit and the other units are transported separately to the building site, and the site equipment is made in the field by preparing overground the working place sheltered from rain for the overground attendance crew from where the operators attend to the driving unit in the pit.

This well-known method of installing a site is very time-consuming, because installing and dismounting the field equipment is very strenuous. Add to it that work under a canvas tent under particularly adverse weather conditions as for example when it is freezing in winter time in practically impossible. Moreover, tents have the disadvantage that they do not protect sufficiently the partially very expensive operating units against unauthorized use and theft.

According to another elaboration of the invention it has been provided that a transport container be arranged above the driving pit and covering it, which has an opening in the bottom near to which a place is provided for the driving unit and through which the driving unit can be hoisted down into the pit. All working tools and appliances for operating the driving unit are permanently housed ready for use in the container.

When using such a container the overground working place remains permanently equipped and connected to the driving unit. During the transport and driving unit is accommodated in the container, whereas when placing the container at the site it need only be hoisted down into the driving pit. During the non-working time the container can remain positively locked. Thus the container can be placed directly on the driving pit covering it so that the pit is protected against all weather and work is not interfered with even in winter time. The most important advantage in conjunction with the container is, however, that the latter can have a such a width that it can be transported on normal trucks.

There are standard containers equipped for transport on a truck. Such containers are used for example also as field offices or attendance crew's quarters. The reduced diameter of the driving pit and the opening in the container bottom qualify such containers, e.g. a 20-foot container, also for the use as a portable field equipment for pipe driving units.

According to another elaboration of the invention at the ceiling of the container a travelling rail for a crane trolley is provided. This travelling rail can be telescoped beyond the container end. Thus the crane trolley can be used on the one hand for lifting up and hoisting down the driving unit and on the other hand for feeding product pipe lengths.

When driving pipes in the ground, experience has shown that the pipe driven-in cannot only change its direction but sometimes it rotates around its own axis. This rotating movement can damage the connections between the individual pipes, which are joined only be mutual pressure. According to another elaboration of the invention it has therefore been provided that outside the jacket of steering head and follower pipe a rudder blade be arranged which can be controlled and swivelled off the drive direction through a certain angle of attack thereby compensating the rotation. This rudder blade is controlled by means of a hydraulic cyclinder arranged inside the steering head or follower pipe.

The invention is illustrated by means of examples of execution represented in the drawing:

FIG. 5 shows a container for operating a driving unit for the underground driving of product pipes of non-man-sized diameters with one end wall removed.

FIG. 7 shows the driving pit sunken into the ground.

FIG. 8 shows the driving pit changed into an inspection pit.

Figure 1:
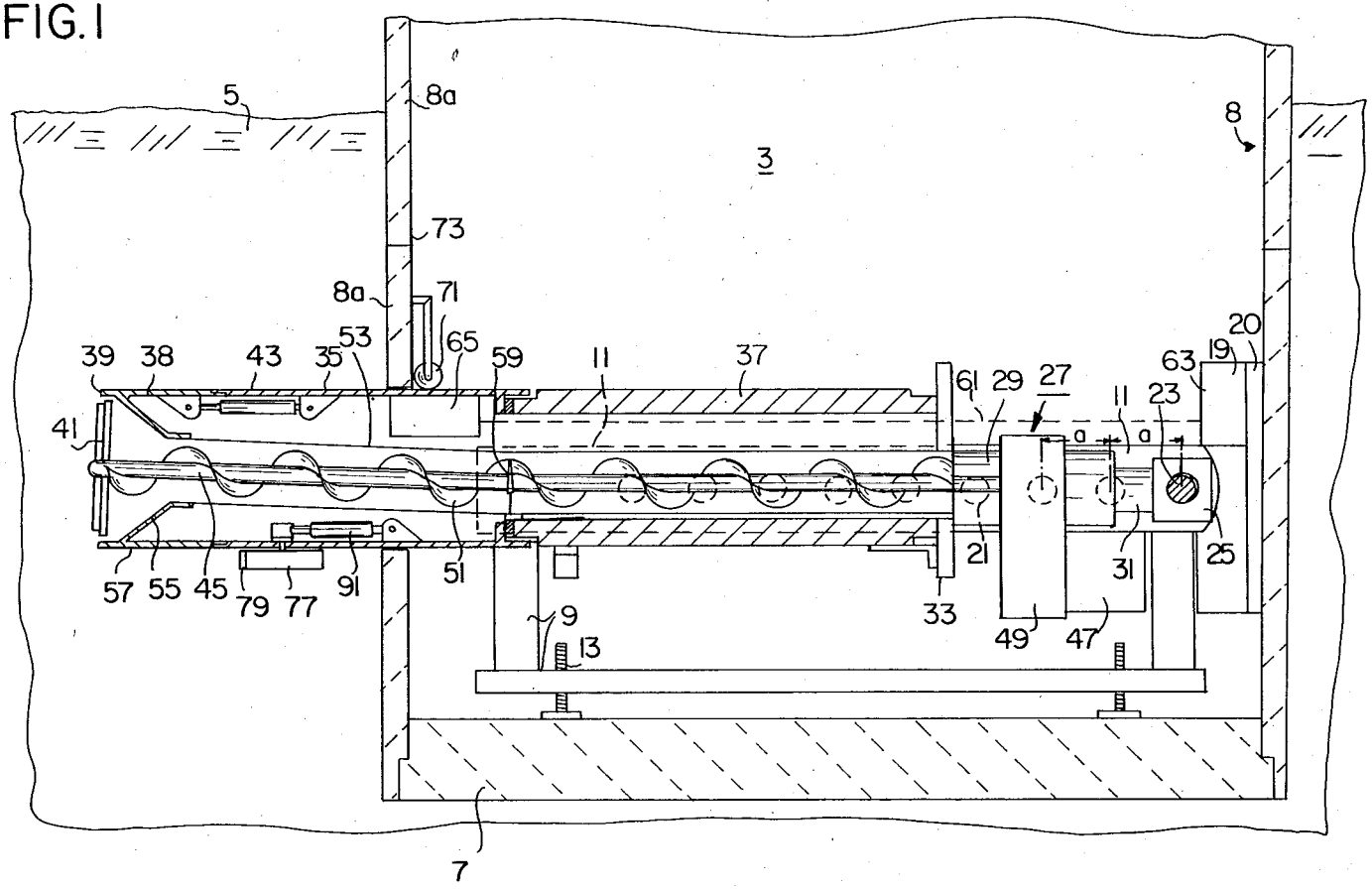
FIG. 1 shows a longitudinal section of the arrangement with thrust bridge, steering head and follower pipe as well as a product pipe placed behind the follower pipe within a driving pit serving as main driving station.

A driving unit 1 as per FIG. 1 serving to drive pipes and rated for nominal diameters of pipes of approx. 250 thru 400 mm (10 thru 16 ins.) is installed inside a driving pit 3 in the ground 5. The bottom of the driving pit 3 having a diameter of approx. 2 m (6'-6") is formed by a slab. The wall 8 of the driving pit has a cylindrical shape and is for example composed of individual concrete rings 8*a* piled up one upon the other and sunk into the ground.

This driving pit 3 with its wall 8 is so built that it can be used as an inspection chamber after completing the driving job between the driving pit and the destination pit. The wall 8 of the driving pit 3 is therefore a wall lining which is sunk into the ground once and remains in it definitively so that its use as a driving pit transits to the use as an inspection chamber.

Figure 2:
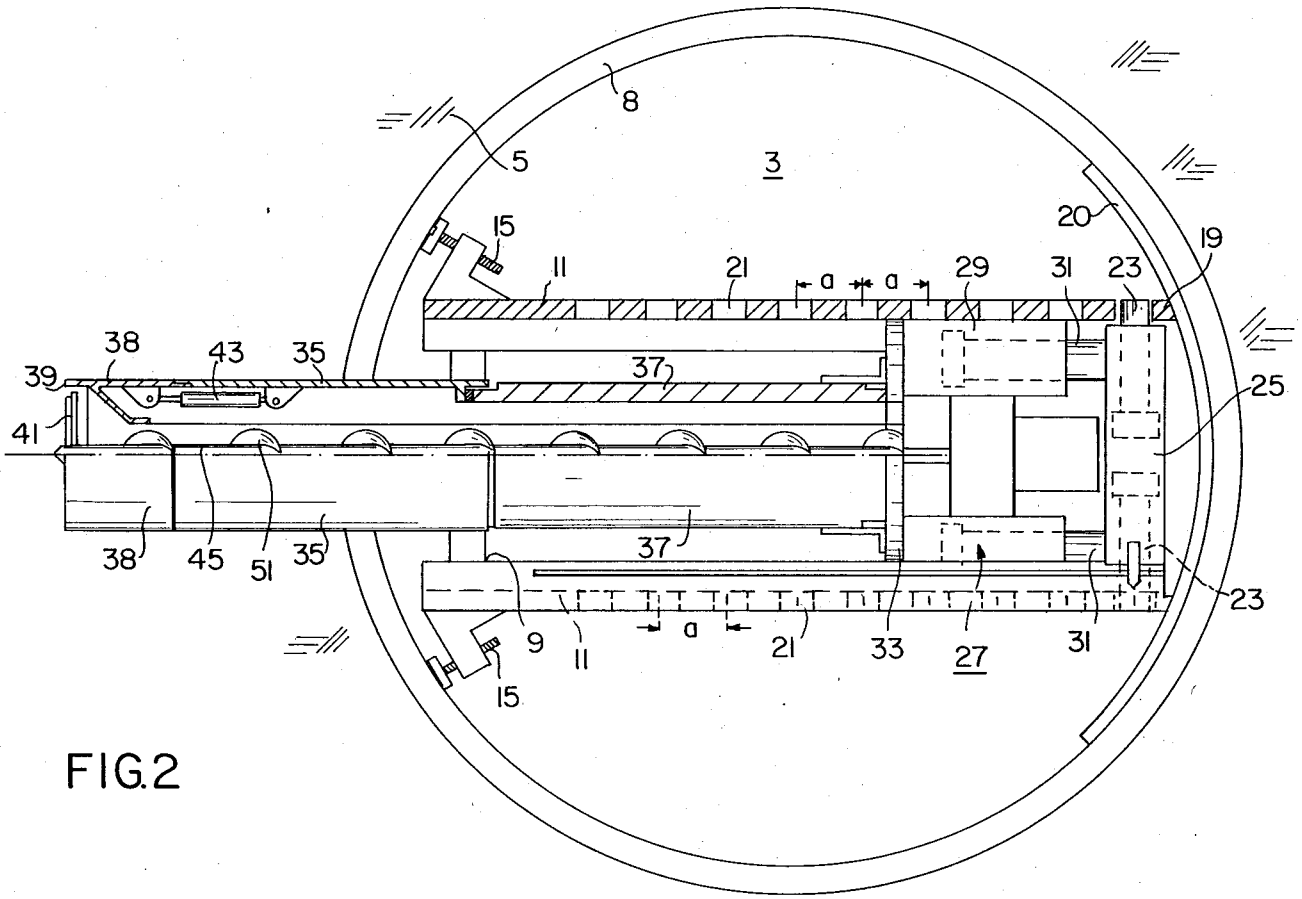
FIG. 2 shows a top view of the arrangement according to FIG. 1, but half-cut and a view from the top into the driving pit.
Figure 3:
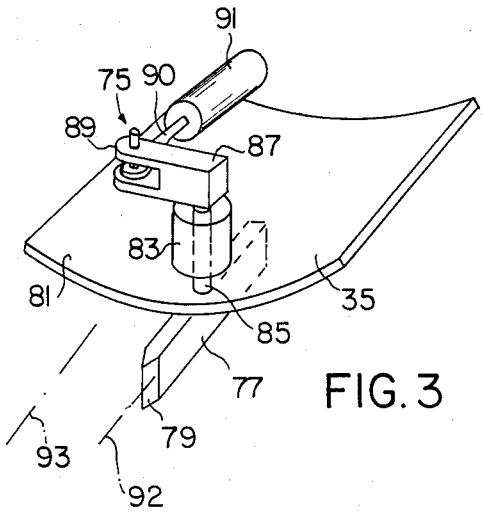
FIG. 3 shows a representation of a contrivance preventing the pipe rotation.

On the slab 7 the driving unit 1 shown here only as an example is placed with a frame 9 which has parallel and equidistant multihole rails 11 (see FIG. 2). The frame 9 can be levelled in its height upon the slab 7 by means of levelling screws 13. The blocking of the drive direction is made at the front side with the blocking screws 15 pressing against the pit wall 8 (see FIG. 2). When driving the product pipes 37 a secure and reliable back-up 19 is required at the pit wall 8. For it a back-up wall 20 is provided matching the curvature of the pit wall 8. The back-up wall covering a quarter or preferably more of the inner circumference of the pit wall finds a positive support at the pit wall 8.

The parallel multihole rails 11 have identical holes 21 at the same height and pitch. The two multihole rails are paparallel to the drive direction. Into the holes 21 locking bolts 23 can be pushed by means of hydraulically operated locking appliances 25. The holes 21 are shown in dashed lines in FIG. 1 and in FIG. 2 in the lower part.

A thrust bridge 27 slides on the frame 9 between the rails 11. Pressing units 29 are mounted to this thrust bridge and work in the drive direction. The hydraulically operated press pistons 31 are connected to the hydraulic locking appliance 25 working at right angles to the drive direction and moving the locking bolts outwards or inwards. Also this locking appliance 25 working at right angles to the drive direction slides on the base frame 11.

For causing an advance drive the locking bolts 23 to begin with are moved into the lefthand and righthand holes 21. The pressing units 29 working in the drive direction then press the thrust bridge 27 forward with respect to the propped-up locking appliance 25, i.e. by one hole pitch, which is approx. 150 mm (6 ins.). Once the distance "a" has been travelled through, the locking bolts 23 are pulled back. The press pistons 31 are then retracted in drive direction by the distance "a". Now the locking bolts 23 are pushed out again, and the drive cycle continues retrogressively, repeated in the way a crabfish walks, until a full pipe length has been driven in.

The thrust bridge 27 carries a drive plate 33 pressing either directly against a follower pipe 35 or against a product pipe already interposed and having a length for example of 1 m (3'-3") and a nominal diameter of 250 thru 400 mm (10 thru 16 ins.). According to the illustrations of FIGS. 1 and 2 the plate 33 presses the product pipe 37, for example a sewer pipe, against the follower pipe 35. The follower pipe in its turn presses against the steering head 38 which excavates the soil in place at its cutting edge 39 by means of a scraper disk 41.

The follower pipe 35 is connected to the steering head via three direction control presses 43 arranged over the circumference. The work and drive direction of the steering head 38 can be corrected with the control presses 43.

The scraper disk 41 is mounted on a drive shaft 45 running through the steering head 38, the follower pipe 35 and the product pipe 37 to the thrust bridge 27. On the latter a drive motor 47 is arranged turning the drive shaft 45 via a gear unit 49.

Around the drive shaft 45 a helical blade 51 is arranged reaching from the scraper disk 41 back to the drive plate 33. The waste excavated by the scraper disk is thereby transported through the pipe arrangement 38, 35, 37 into the driving pit 3. In order to keep the waste soil to be transported within the section of the helical blade 51, the latter is enclosed by a guide pipe 53. The guide pipe 53 is connected in the steering head 38 to a funnel-shaped cup 55 which runs near the steering head cutter edge 39 to the steering head jacket 57.

The guide pipe 53 and the drive shaft 45 of the helical blade 51 can be taken apart and put together in the areas of junction 59 of the pipes, i.e. always between the product pipes or between product pipe and follower pipe 53. For the product pipes 37 following-up, guide pipe lengths of approx. 1 m (3'-3") and drive shaft lengths of approx. 1 m (3'-3") according to the product pipe length are held on hand.

Keeping the reference drive direction is ensured by means of a laser beam 61. This laser beam is projected by a laser unit 63 and hits and electronic target plate 65 mounted in the follower pipe 35. Thus the laser beams goes from the rear back-up wall 67 through the whole pipe train to the target plate 65. The latter need not necessarily be mounted in the follower pipe 35. It can also be arranged in the steering head. The coordinates of the light spot obtained by means of the laser beam on the target plate 65 show exactly the deviation of the pipe train from the desired course (reference axis). The coordinates are transmitted to a digital display unit in the driving pit 3.

At the same time the coordinates obtained are fed to a computer and converted into control commands. The control commands are transmitted to three direction control presses 43 and transformed into specific stroke lengths of the control presses 43. The stroke lengths of the control presses are scanned by electronic linear encoders to be displayed digitally and to be checked.

The pipe length driven forward is measured by means of a measuring wheel 71 running on the follower pipe 35 or product pipe 37. The measuring wheel is mounted on the front side 73 of the pit wall 8. The values measured are also displayed digitally on a display panel. The measurement of the driven length permits to calculate the position of the steering head 38 in the ground 5. Simultaneously it serves to initiate direction control compensating cycles. Depending on the soil conditions the direction control compensating cycles can be effected in intervals of 10 cm to 1 m (4 thru 40 ins.). This means that after driving lengths of 10, 20, 30 cm (4, 8, 12 ins.) etc. depending on the soil conditions the direction control compensation can be made.

During the operation it can happen that the steering head 38 rotates around its axis when being driven in. In order to counteract this rotation a rotation compensation device 75 is provided on the follower pipe 35, the most essential part of which is a long and straight direction control rudder blade 77. The rudder blade 77 has a sharp edge 79. Inside the wall 81 of the follower pipe 35 at the bottom part a guide bush 83 is welded on through which passes a shaft 85 carrying the rudder blade 77. Inside the follower pipe the shaft 85 is connected to a one-armed lever 87 which rotates around the shaft 85. At the free end 89 of the lever 87 a control rod 90 of a hydraulic control cylinder 91 is connected.

As long as there is no rotation, the longitudinal axis 92 of the rudder blade 77 is parallel to the drive direction 93. But when rotation occurs, it is detected to begin with on the target plate by means of a compensating unit not discussed here. This compensating unit measures the rotation of the steering head 38 around the pipe axis in the range of $\pm 15°$. The rotation is displayed digitally in the driving shaft 3. Whenever a rotation occurs the control rudder 77 is turned through a certain angle with respect to the reference drive direction 93 by means of a control appliance 91. This causes a positvely controlled rotation of the steering head 38 around the pipe axis so that the steering head 35 will slowly rotate back into the reference position when driving continues.

Figure 4:
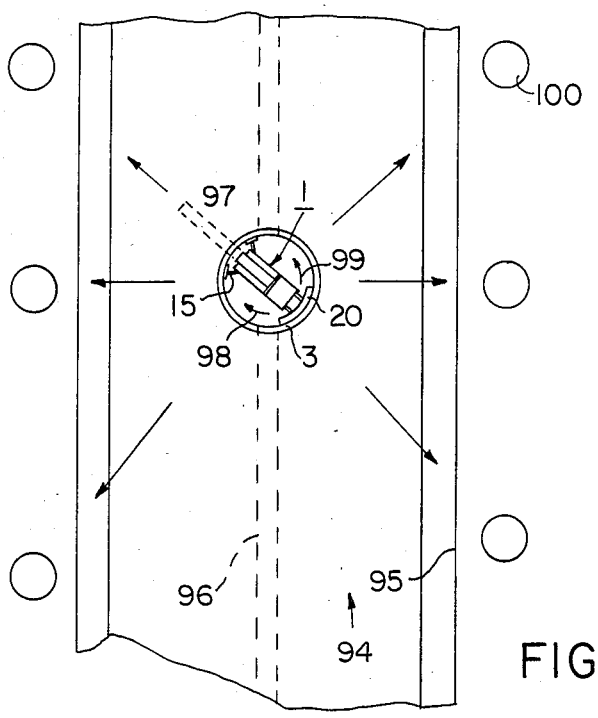
FIG. 4 shows by means of a general plan the method of operation for driving collector drains and house sewers of a sewer system from an inspection chamber with the help of a driving unit working in an inspection chamber used as driving pit.

FIG. 4 shows a street section with the pavement 94 in the middle and lay-byes at the street verge 95. In this street section a collecting drain 96 and house sewers 97 are installed, which lead to the collecting sewer 96. The job is started by sinking pit rings 83 for making the inspection chamber 3, which, however, will be used during the work as a driving pit 3.

The driving unit 1 is installed in the driving pit 3. In the pit 3 the unit finds space enough to be rotated and oriented in the direction of the arrows 98, 99. After orienting the unit, the back-up wall 20 and the front props 15 are moved out and pressed against the pit wall 8.

The collecting drain 96 represented in dashed lines in the middle of the street pavement 94 has already been completed by the underground driving method. Now driving of the house sewers starts from the driving pit 3. The drive direction to the house inspection chambers 100 is indicated by arrows.

The driving unit 1 is now turned into the direction of one of the house inspection chambers 100 and blocked again. Advance driving starts; a part of the pipe train has already been driven in FIG. 4. The same procedure applies to the other house sewers 97.

For several house sewers and drains in a street within the street area only the sinking and operation of one single driving pit is necessary. Because of the concentrated field equipment traffic obstruction is reduced. Time of work is minimized, as only one pit has to be built, which later-on serves a an inspection chamber. The street surface is unpaved only in the area of the pit to be built. These inspection chambers are only required at larger distances. The re-paving costs for the street covering after completing the job are diminished; as re-pavement mostly leaves clearly marked traces, the aspect of the street surface when using this method is almost not deteriorated.

FIG. 5 shows a transportable work outfit unit 101. Such a transportable work outfit is a field equipment which can be moved in one lot or as a unit from site to site. The work outfit consists of a standard 20-foot container 103. The standard container on one end wall 105 has door wings 107, hatched in the illustration.

Inside the container 103 the overground operating appliances such as a compressor 109, a pressure vessel 111 and a power control unit 113 are mounted and installed. These units serving for the supply of power media are housed in the container part 115 separated by a partition wall from the other container part 119.

In the remaining part of the container the driving unit 1 is accommodated. This driving unit 1 is placed in 123 above an opening 125 in the bottom 127 of the container 103. The opening 125 is so dimensioned that the driving unit 1 can be hoisted through the opening 125 from the container 103.

The driving unit 1 is connected via supply lines 129 to the central control cabinet 131. This central control cabinet 131 is for example mounted on the bottom 127 of the container 103 near the opening 125.

At the ceiling 133 of the container there is a travelling rail 135 for the crane trolley 137.

This transportable work outfit unit can be loaded and transported on a truck suitable for container transport. The transportable work outfit unit is always complete and ready for use; it is transported together with the driving unit accommodated in the container from site to site and is simply placed on top of a driving pit prepared beforehand. For a driving pit diameter of approx. 2 m (6'-6") the container covers the driving pit completely so that the job can be done irrespective of weather conditions. This means that sewer construction can also be made in winter time.

Figure 6:
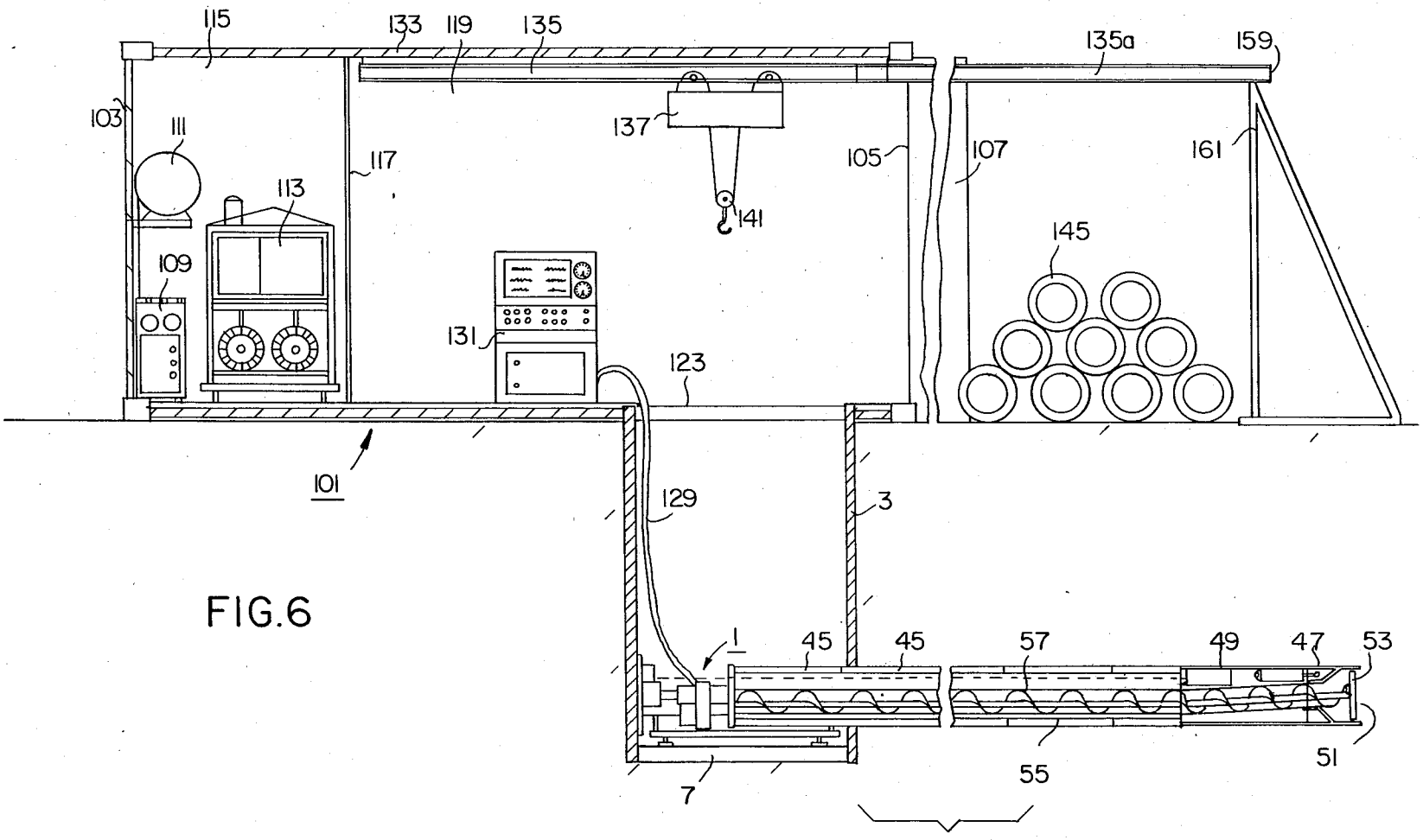
FIG. 6 shows the container at the site placed on top of a cylindrical driving pit, e.g. for installing sewer pipes.

FIG. 6 shows the container 103 shown in FIG. 5 placed on top of a driving pit 3. By means of the crane hook 141 of the trolley 137 the driving unit 1 is hoisted down onto the bottom 7 of the driving pit. The supply line 129 still connects the driving unit 1 with the central control cabinet 131. Into the driving unit product pipes 45 are placed one after the other and following a steering head 47 and a follower pipe 49 are pressed into the ground when driving. The soil in place at the face breast 51 is excavated by a scraper disk 53 and conveyed back to the driving pit by a conveyor worm 57 guided in a guide pipe 55. For a driving pit diameter of approx. 2 m (6'-6") the length of the individual product pipe 45 is approx. 1 m (3'-3").

The crane travelling rail 135 can be extended beyond the container 103 by a rail section extension **135*a* the free end of which 159 is underpropped by supports 161. Thus the trolley 137 can overtravel the container 103, pick up product pipe lengths 145** and hoist them down into the driving pit.

FIG. 7 points out the cylindrical shaped driving pit 3 down pavement 94 with the wall 8 of the individual concrete rings **8*a* piled up one upon the other and sunk into the ground. The bottom of the driving pit 3 is the slab 7. Are the collection drain 96 and the house sewers 97 out goin from the driving pit 3 installed, than will be reinforced within the driving pit with concrete a control chamber 145, house sewers inlets 147 and lower courses 149 of this inlets (FIG. 8). The highest of the concrete rings 8*a* will be with-drawn and substituted by a cap 151 with manhole pit 153. The driving pit 3** now is changed into a inspection pit.

What is claimed is:

1. An apparatus for laying underground segments of pipeline along street routes from within jacking shafts disposed in the ground along the street comprising jacking shafts comprised of tubular concrete rings provided in the ground allowing access for jacking pipeline segments and for serving later as manholes, the jacking of the pipeline segments being effected by a jacking apparatus lowerable into the jacking shaft and operable therewithin such that inside an interior portion thereof and restricted thereto, the jacking apparatus can be rotated and steered in any desired jacking direction, whereby said apparatus is particularly adapted to lay sewer pipes and mains having non-man-accessible pipe cross-sections.

2. An apparatus as defined by claim 1, further comprising the jacking apparatus is supported within the jacking shaft by means of a jacking wall having an arcuate cross section that is adapted to be complementally received against an interior wall of the jacking shaft.

3. An apparatus as defined by claim 1, further comprising the jacking apparatus being provided with a control head having a scraper disk rotatable therein, said control head being advanced in the ground by the jacking apparatus by successive following pipeline segments, and a ratio of a jacking shaft diameter to pipe segment length is established at approximately 2 to 1, said jacking shaft normally being 2 meters in diameter.

4. An apparatus as defined by claim 3, further comprising said scraper disk is rotated by a shaft guided within a pilot tube, said shaft having a rotatable auger flight, and the shaft and pilot tube are comprised of segments whose length is also approximately 1 meter.

5. An apparatus as defined by claim 2, further comprising the control head includes a jacket exteriorly of which a control vane is provided, which control vane is adjustable to assume a jacking direction other than that being travelled by said shaft by a predetermined positioning angle, whereby the control vane can correct any diversion from the desired pipeline path.

6. An apparatus as defined by claim 5, further comprising the control vane is disposed on a bottom surface of the jacket and is adjustable by means of an hydraulic adjusting cylinder located within the control head.

7. An apparatus as defined by claim 1, further comprising said jacking apparatus is operable from ground level via an energy supply unit positively mounted within a ground level container and the jacking apparatus includes a stand provided in the container disposed above an opening in the container floor, through which opening the jacking apparatus can be lowered into the jacking shaft.

8. An apparatus as defined by claim 5, further comprising a width of the container is selected such that it is substantially the diameter of the jacking shaft.

9. An apparatus as defined by claim 5, further comprising that the container is a standard size shipping container and said jacking apparatus, said energy supply unit, and controls and associated equipment therefor are containerized into a portable unit by said container.

10. An apparatus as defined by claim 5, further comprising a travel rail and a crane are provided on a roof of the container, said travel rail allowing the jacking apparatus to be lowered into and raised out of the jacking shaft so that pipe segments, partial pilot tube segments and partial shaft segments can be delivered therein.

11. An apparatus as defined by claim 10, further comprising the travel rail is adapted to be extended outwardly through a door opening in a container end wall, whereby said segments can be procured from a storage location.

* * * * *